United States Patent [19]

Janssen

[11] 4,048,763

[45] Sept. 20, 1977

[54] METHOD FOR SURFACE-, PLANE-PARALLEL-, AND PLAIN LAPPING

[75] Inventor: Jos M. Janssen, Mettmann, Germany

[73] Assignee: JMJ Werkzeugmaschinen GmbH fuer Feinbearbeitung, Mettmann, Germany

[21] Appl. No.: 659,578

[22] Filed: Feb. 19, 1976

Related U.S. Application Data

[62] Division of Ser. No. 605,156, Aug. 15, 1975, Pat. No. 3,978,621.

[30] Foreign Application Priority Data

Aug. 27, 1974 Germany ..... 2440978

[51] Int. Cl.[2] ..... B24B 1/00

[52] U.S. Cl. ..... 51/281 SF; 51/292

[58] Field of Search ..... 51/281 R, 281 SF, 292, 51/263

[56] References Cited

U.S. PATENT DOCUMENTS

| | | | |
|---|---|---|---|
| 1,771,408 | 7/1930 | Hitchcock | 51/263 X |
| 3,063,206 | 11/1962 | Meyerhoff | 51/263 X |
| 3,117,397 | 1/1964 | Taylor | 51/263 X |
| 3,500,591 | 3/1970 | Gawronski | 51/292 X |
| 3,638,366 | 2/1972 | Gamache | 51/263 X |

*Primary Examiner*—Al Lawrence Smith
*Assistant Examiner*—Nicholas P. Godici
*Attorney, Agent, or Firm*—Martin A. Farber

[57] ABSTRACT

A method for surface-, plane-parallel-, and external plain lapping of starting work pieces with a lapping abrasive which is fed on a circularly shaped lapping abrasive track in determined quantity to the starting work pieces, and by which the starting work pieces are machine formed into face, plane-parallel or round finished work pieces. The lapping abrasive is fed to the starting work pieces on at least one additional circularly shaped lapping abrasive track or channel arranged concentrically to the first circularly shaped lapping abrasive track and having a different diameter, and in a differently dosed quantity relative to the first lapping abrasive quantity and separate from it.

5 Claims, 4 Drawing Figures

11a
12
22
21
20
62
41
57
64
60
40
10
24
23
29
30
26
25
28
27
27
11
13
15
16
17
18
14

METHOD FOR SURFACE-, PLANE-PARALLEL-, AND PLAIN LAPPING

This is a division of application Ser. No. 605,156, filed Aug. 15, 1975, now U.S. Pat. No. 3,978,621.

The present invention relates to a method surface-, plane-parallel-, and external plain or cylindrical-lapped of unmachined or rough worked starting work pieces with a lapping abrasive which is fed on a circularly shaped lapping abrasive track in determined quantity to the starting work pieces, and by which the starting work pieces are machine formed into face, plane-parallel or round finished work pieces.

It is known to feed the lapping abrasive to the work pieces via a circularly shaped channel on the upper lapping wheel carrier and several bores through the carrier and the lapping wheel. With this, the evenness of the lapping wheels, which is essential for attaining high precision of the work pieces, is not always maintained. The lapping wheels operate uneven with time and must consequently be levelled or faced (turned) in irregular intervals. For the levelling of the lapping wheels, the upper wheel is swung eccentrically relative to the lower wheel. When the wheels run directly on each other in this position, they reciprocally level themselves. Thereby, the evenness of the lapping wheels again is produced.

Rough or uneven errors in the working surfaces of the lapping wheels are removed with the turning device. Moreover a tool holder with a turning tool is used. If the upper wheel is worked, the turning tool is arranged next to the lower wheel. The upper wheel then travels over the tool. During the working of the lower wheel, the tool is arranged in the center of the upper wheel. The feed or advance in both cases is brought about by means of the hydraulic movement of a pivot arm, which has a spindle sleeve for the support of the upper lapping wheel. The advance is continuously controllable within wide limits. The cutting depth is adjustable by means of a hand wheel.

Another known type which levels the working surfaces of the lapping wheels, resides in three or four toothed levelling annular elements or rings which are allowed to run between the lapping wheels. The rings mutually have the exact same height. They are larger in diameter than the ring or annular width of the lapping wheels.

The levelling or facing of the lapping wheels, according to more or less of a large number of working procedures, is a time consuming process, during which the machine is not available for use, so that then lapping can not take place, but rather again it is being made available for use. This process increases thus the non-productive time in the cost of the essential operating time. In addition, there is the set-up and shut-down time for the preparation of the machine for the levelling or facing of the lapping wheels, and after the restoration of the operability of the machine, the set-up and shut-down time for the preparation of the machine for the lapping.

For the facing or turning of the lapping wheels, a tool holder with a levelling tool in the form of a turning tool is necessary from a technical apparatus viewpoint. For the advance during the levelling or facing of the lapping wheels, a piston drive with pinions for the hydraulic swinging of the pivot arm is provided in the rearward part of the pivot arm.

In order to be able to carry out the levelling or facing or the reciprocal smoothening of the lapping wheels with the greatest possible advance speed for the necessary working process under the circumstances, in the known machines, the pivot arm is provided with an expensive hydraulic drive. By means of this drive, the pivot arm can travel with continuously adjustable speed. Moreover, the pivot arm must have a device for the feed of the turning tool during the facing or levelling of the lapping wheels.

The restoration of the evenness and parallelism of the working surfaces of the lapping wheels thus requires, as a condition for the evenness and parallelism of the work pieces to be worked between the wheels, a very high expense with respect to processing technique as well as with respect to utility of apparatus.

Accordingly, it is an object of the present invention to provide a method for lapping which avoids the above-mentioned disadvantages. Consequently, it is an object of the invention to provide a method for surface-, plane-parallel-, and plain- lapping of the introductory mentioned type, avoiding the previously described technical procedural and apparatus-connected disadvantages and defects of the known methods and machines, such that alone by the type of feed of the lapping abrasive and the dosing of the lapping quantity between the working surfaces of the working wheels and the work pieces, the quality of the work pieces with respect to evenness and parallelism of their surfaces is improved.

This object is solved in accordance with the present invention in the manner that the lapping abrasive is fed to the starting work pieces on at least one extra circularly shaped lapping abrasive track or path arranged concentrically to the first circularly shaped lapping abrasive track and having a different diameter, in a differently dosed quantity relative to the first lapping abrasive quantity and separate from it.

The technical advance attained by the invention is based on the following advantages: By means of the different dosing of the lapping abrasive quantity on the different lapping abrasive tracks, the evenness of the working surfaces of the lapping wheels can be continuously controlled in the sense of a correction, and with this the quality of the work pieces with respect to the evenness and parallelism of their surfaces.

By quantity balanced dosing of the lapping abrasive amount, which is dependent on the type and degree of the wear of the lapping wheels, the time consuming and troublesome mutual or reciprocal levelling of the lapping wheels which are off-set eccentrically to each other, can be avoided by direct running of the lapping wheels on one another or by means of several levelling rings between the lapping wheels. Rough errors in the working surfaces of the lapping machine no longer occur. As a consequence of this, the lapping wheels no longer need to be faced or turned. In this manner, there is avoided the idle process time which is necessary for restoring the lapping wheels and the entire technical expense for levelling the lapping wheels comprising the advance apparataus and the feed device for the work tools.

With the two wheel lapping machine for carrying out the method for the surface-, plane-parallel-, and external plain- lapping of the invention, with two lapping wheels or working wheels, which are mounted each on one lapping wheel carrier, respectively, of which the upper lapping wheel carrier has a circularly shaped track or channel at the lower end of a main spindle, which channel is for feeding the lapping abrasive by means of a dosing device, according to the invention the upper lapping wheel carrier is provided with at least one second circularly shaped channel, for feeding the lapping abrasive which is arranged concentrically to the first circularly shaped channel and has a different diameter.

In this manner, it is possible to apply and distribute the lapping abrasive in two lapping abrasive paths which are arranged concentrically to each other onto the working surfaces of the lapping wheels, and consequently to control the evenness thereof. This furthermore influences the evenness and parallelism of the surfaces of the work pieces which are to be worked. With this, the additional mutual levelling of the lapping wheels, with or without toothed leveling rings between them, or the facing of the lapping wheels, are avoided with the consequent necessarily large technical expense.

Further important features of the invention are set forth as follows, although not limited thereto. In order to dose the lapping abrasive according to quantity, the dosing device is formed as a double apparatus with two inlet tubes and two outlet tubes, which are adjustable relative towards one another.

If during the working, the working surfaces of the lapping wheels incline, a concave shape is assumed, and it is possible, for example, thereby to feed more lapping abrasive to the outer lapping abrasive track than to the inner lapping abrasive track, so that the removal of working material is larger outwardly than inwardly. If the working surfaces of the lapping wheels assume a convex form during the working, the inner lapping abrasive track can be fed with more lapping abrasive.

In order to regulate the lapping abrasive quantity to be fed to each channel, the inlet tubes are mounted, with respect to the rigidly arranged outlet tubes, displaceable perpendicularly to their flow-through passage direction, and hydraulically switchable on and off.

In one practical embodiment, the inlet tubes are secured in each one piston, the latter being axially displaceable by means of a pressure medium against the force of a spring.

Advantageously, the stroke of the pistons are adjustable each by means of a setting screw, the latter being held fixed by means of an annular nut in its respective position.

So that the lapping abrasive quantity to be fed to the channels acts essentially proportionally to the stroke of the pistons, the inlet tubes narrow into gap formed openings on their ends opposite to the outlet tubes.

With the above and other objects in view, the invention will be more clearly understood from the detailed description of a preferred embodiment, in connection with the accompaning drawings, in which.

Figure 1:
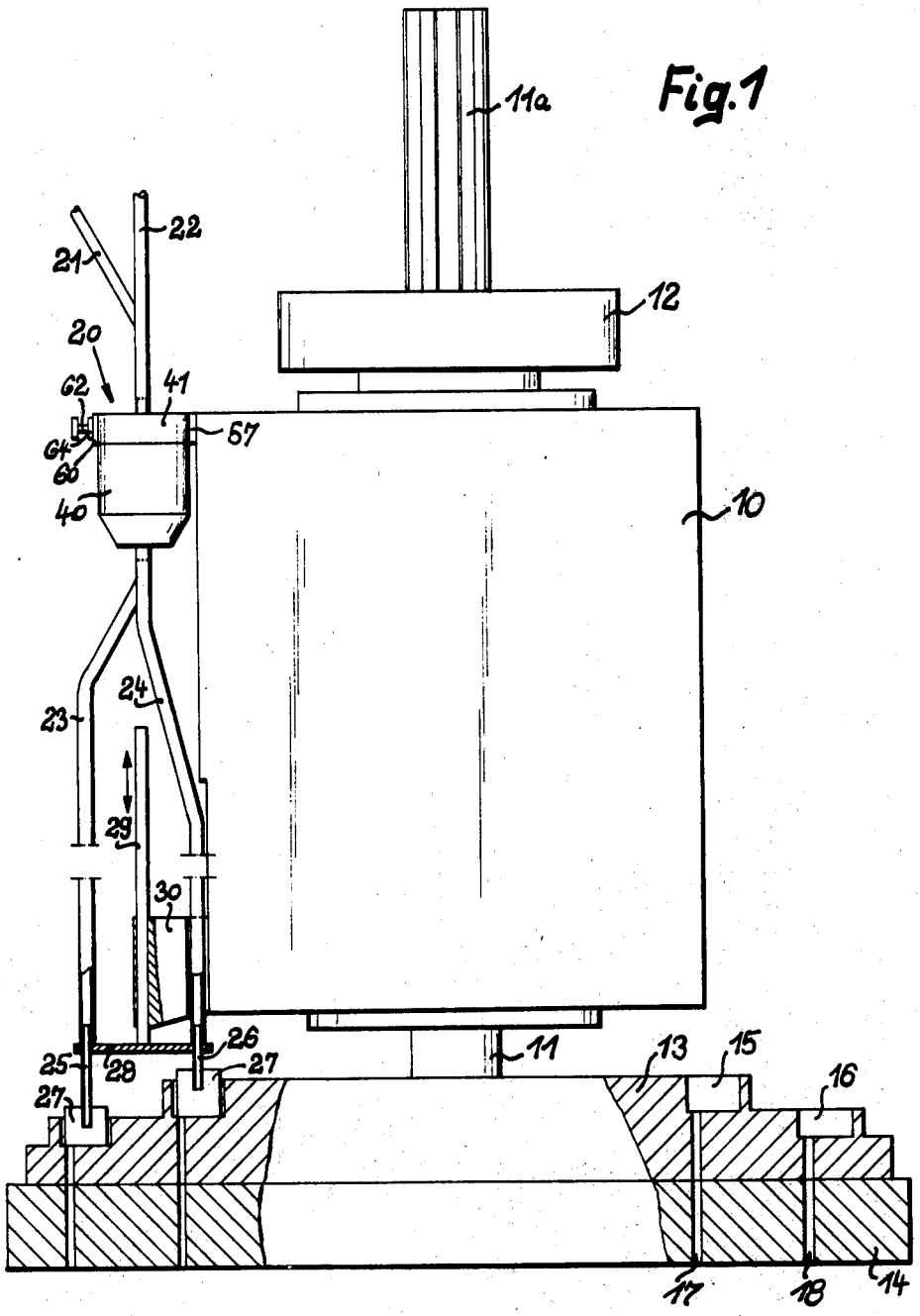
FIG. 1 is an elevational view partly broken away and sectioned of the upper part of an example of a lapping machine for carrying out the method in accordance with the invention.

Referring now to the drawings, and more particularly to FIG. 1 - 4, a main spindle 11 is rotatably and axially displaceably supported in the upper spindle housing 10 of a lapping machine. The upper end of the main spindle 11 is formed as a multi-spline shaft **11*a*, on which a drive wheel or sheave 12 is secured, for example, a toothed or gear belt pulley. The drive wheel 12 is driven by means of a force transmission means (not shown), for example, a toothed or gear belt. An upper circularly (annularly) shaped lapping wheel carrier 13 is provided on the lower end of the main spindle 11, to which carrier there is secured an upper circularly shaped lapping wheel 14. Symmetrically oppositely below the upper lapping wheel 14**, there is mounted the operatively cooperating lower lapping wheel of the two wheel lapping machine (not shown).

The lapping wheel carrier 13 is provided with with two annularly or circularly shaped upwardly opening tracks or channels 15 and 16 which have diameters differing from each other and which are concentrically arranged with respect to one another on respective longitudinally off-set portions of the lapping wheel carrier 13. A plurality of bores 17 and 18, disposed approximately at uniform distances from each other, are formed extending through the lapping wheel carrier 13 and the alpping wheel 14, feeding out from the bottom of the channels 15 and 16.

A dosing device 20 is laterally provided on the spindle housing 10, which device is equipped as a double apparatus with two inlet conduits 21 and 22 and two outlet conduits 23, 24, preferably flexible hoses. The outlet conduits 23 and 24 terminate in tube pieces 25 and 26 to which there are fastened strippers 27, which stroke the lapping abrasive exiting from the tube pieces 25 and 26 in the bores 17 and 18 during rotation of the lapping wheel carrier 13. The tube pieces 25 and 26 are fastened to a cross piece 28, which is vertically guided in a guide piece 30 on the spindle housing 10. During lowering of the lapping wheel carrier 13 with its lapping wheel 14 from the position represented in FIG. 1 in its working position, still also for equalization of wear of the lapping wheel 14, the guide rod 29 with its cross piece 28, moves therewith the tube pieces 25, 26, the strippers 27 and the flexible lapping abrasive conduits 23 and 24.

Figure 3:
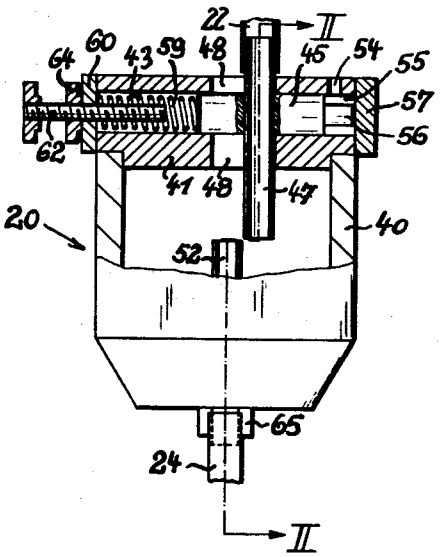
FIG. 3 is a partial section along the lines III — III of FIG. 4.
Figure 2:
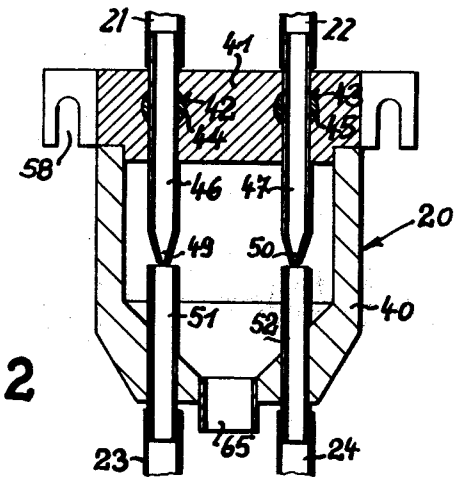
FIG. 2 is a section of the dosing device taken along the lines II — II of FIG. 3.
Figure 4:
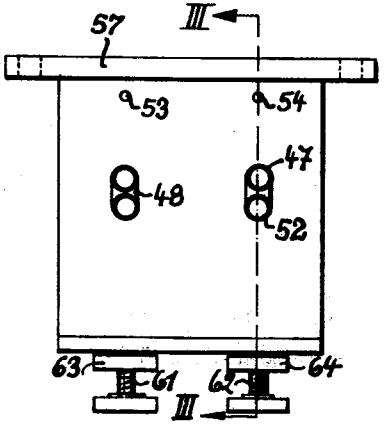
FIG. 4 is a plan view of a dosing device in accordance with the present invention.

The dosing device 20 itself comprises a container 40 with a cover 41 which has two bores 42, 43 passing therethrough in which two pistions 44, 45 are axially displaceably guided (FIGS. 2 and 3). The pistons 44 and 45 each receive in one vertical cross bore, respectively, thereof, an inlet tube 46 and 47, respectively, the latter being rigidly connected with the respective piston 44 and 45, and linearly moveable therewith in laterally widened longitudinal holes 48 in the cover 41.

The inlet tubes 46 and 47 taper at their ends which are disposed inside of the container 40 into gap formed openings 49 and 50. These openings end oposite outlet tubes 51 and 52, respectively, the latter being rigidly arranged in the container 40 and connected with the outlet conduits 23 and 24, respectively. The ends of the inlet tubes 46 and 47 which project from the cover 41 are connected with a mixing container (not shown) via the inlet conduits 21 and 22. In the mixing container, the loose lapping abrasive grain is mixed with the liquid lapping abrasive carrier in which it is suspended.

The pistons 44 and 45 are driven by means of a pressure means, which originates from a source of pressure means (not shown) and is introduced through bores 53 and 54 into the cylinder spaces 55 fowardly ahead of the pistons. For the formation of the cylinder spaces 55, the pistons 44 and 45 are off set at their front sides into pins 56 which have a smaller diameter than the pistons 44 and 45 and the cover 41 is closed off by a flat piece 57 having suspension or mounting slots 58. Helical springs 59 which are supported on a cover bar 60 continuously bias and hold the pistons 44 and 45 in their end postions. The stroke of the pistons 44 and 45, respectively, is adjustable by means of a setting screw 61, 62, respectively. The setting screws are each held fixed in their then existing position by means of an annular nut 63, 64, respectively.

The dosing device 20 operates as follows: The prepared lapping abrasive continuously flows through the inlet conduits 21 and 22 and the inlet tubes 46 and 47 into the container 40 and arrives back at the mixing container by means of an outlet conduit 65. When lapping abrasive flows in the channels 15 and 16, the cylinder spaces 55 are loaded by the pressure medium, which pushes the the pistons 44 and 45 back against force of their respective compression springs 59. In this manner the inlet tubes 46 and 47 arrive over the outlet tubes 51 and 52, so that the lapping abrasive flows through the outlet conduits 23 ana 24 into the channels 15 and 16. If less lapping abrasive is to be fed, the setting screws 61 and 62 are adjusted in the direction of the pistons to loosen the annular nuts 63 and 64, and then again are held fast by means of the annular nuts. The inlet tubes now are disposed only still with a fraction of their tapered opening 49 and 50 remaining over the outlet tubes 51 and 52, so that also only a fraction of the lapping abrasive falls in the outlet tubes. Surplus lapping abrasive flows back to the mixing container via the outlet conduit 65.

The pistons 44 and 45 can also be acted upon individually so that only one channel 15 or 16 is fed with lapping abrasive. By means of different settings of each of the adjustment screws 61 and 62, the channels 15 and 16, selectively, can be fed with more or less lapping abrasive. Thus varying proportionate amounts of lapping abrasive can be fed to each channel 15 and 16. In accordance with the invention, further additional channels of different diameters and corresponding additional dosing conduits (not shown) can be provided.

While I have disclosed one embodiment of the present invention, it is to be understood that this embodiment is given by example only and not in a limiting sense.

I claim:

1. A method for surface lapping, plane-parallel lapping and plain lapping of workpieces with a lapping abrasive, comprising the steps of feeding a definite quantity of a lapping abrasive on a work piece in at least two radially spaced apart and operatively separated circular paths on the work piece which paths, respectively, are concentric to one another and have different diameters, feeding the lapping abrasive separately in different dosed quantities in each of said at least two paths, respectively, and machining said work piece with said lapping abrasive in said at least two radially spaced apart and operatively separated paths and in said differently dosed quantities, respectively, into a surface finished, plane-parallel finished and plain finished work piece, respectively.

2. The method as set forth in claim 1, further comprising the steps of feeding a larger quantity of the lapping abrasive to an outermost of said at least two circular radially spaced apart and operatively separately circular paths on the work piece so that a removal of working material is greater at the outermost corresponding position on the work piece.

3. The method as set forth in claim 1, further comprising the steps of feeding a larger quantity of the lapping abrasive to an innermost of said at least two circular radially spaced apart and operatively separately circular paths on the work piece so that a removal of working material is greater at the innermost corresponding position on the work piece.

4. The method as set forth in claim 1, wherein said at least two radially spaced apart circular paths are maintained completely circular and operatively separated from one another spaced by the different diameters on the work piece by feeding the lapping abrasive in each of said paths continuously and simultaneously at a uniform plurality of radially equal locations of each circular path.

5. The method as set forth in claim 4, further including the step of separately forming first completely spaced full circular tracks continuously filled with the lapping abrasive and concentric to each other, respectively, on an upper lapping wheel carrier, and flowing the lapping adhesive from said spaced circular tracks through the upper lapping wheel carrier onto the work piece into said radially spaced apart circular paths, respectively, to said plurality of said radially equal locations on each of said radially spaced apart circular paths, respectively.

* * * * *